US007002477B1

(12) United States Patent
Camhi

(10) Patent No.: US 7,002,477 B1
(45) Date of Patent: Feb. 21, 2006

(54) MONITORING SYSTEM

(75) Inventor: Eli Camhi, Scarsdale, NY (US)

(73) Assignee: Accutrak Systems, Inc., Scarsdale, NY (US)

( * ) Notice: Subject to any disclaimer, the term of this patent is extended or adjusted under 35 U.S.C. 154(b) by 180 days.

(21) Appl. No.: 10/789,341

(22) Filed: Mar. 1, 2004

Related U.S. Application Data

(62) Division of application No. 09/294,034, filed on Apr. 19, 1999, now Pat. No. 6,762,684.

(51) Int. Cl.
*G08B 23/00* (2006.01)

(52) U.S. Cl. ..... 340/573.1; 340/539.13

(58) Field of Classification Search ..... 340/573.1, 340/572.1, 994, 433, 539.13, 539.14, 539.15, 340/539.23, 5.8, 5.81, 825.36; 701/207
See application file for complete search history.

(56) References Cited

U.S. PATENT DOCUMENTS

| | | | | | |
|---|---|---|---|---|---|
| 4,241,403 | A | | 12/1980 | Schultz | |
| 4,325,057 | A | * | 4/1982 | Bishop | 340/994 |
| 5,058,044 | A | | 10/1991 | Stewart | |
| 5,144,301 | A | * | 9/1992 | Jackson et al. | 340/994 |
| 5,223,844 | A | | 6/1993 | Mansell | |
| 5,430,432 | A | | 7/1995 | Camhi | |
| 5,450,321 | A | | 9/1995 | Crane | |
| 5,497,149 | A | | 3/1996 | Fast | |
| 5,519,621 | A | | 5/1996 | Wortham | |
| 5,552,772 | A | | 9/1996 | Janky | |
| 5,736,940 | A | * | 4/1998 | Burgener | 340/994 |
| 5,825,283 | A | | 10/1998 | Camhi | |
| 6,262,660 | B1 | * | 7/2001 | Segale et al. | 340/539.15 |
| 6,556,903 | B1 | * | 4/2003 | Chinigo et al. | 701/29 |
| 6,667,686 | B1 | * | 12/2003 | Talbot | 340/433 |

* cited by examiner

*Primary Examiner*—Toan N. Pham
(74) *Attorney, Agent, or Firm*—Seth Natter; Natter & Natter

(57) ABSTRACT

A processor implemented monitoring system includes a sensor coupled to the processor for sampling a physiological parameter of a subject which may comprise a subject unique identification parameter. Also coupled to the processor is a physical location determining device. Subject location as well as parameter status data are input to the processor which is programmed to determine whether the parameter and/or location data falls within prescribed boundaries stored in a memory. Upon determination of an out of boundary condition, e.g. subject entered proscribed geographic area, monitored medical parameter, e.g. blood pressure, out of limit or an unauthorized person attempting to operate a vehicle, etc., the processor transmits information pertaining to the subject, the off limit condition and the specific geographic location of the subject to a central monitoring station for implementation of appropriate action.

5 Claims, 5 Drawing Sheets

MONITORING SYSTEM

This application is a Divisional of 09/294,034 filed Apr. 19, 1999 now U.S. Pat. No. 6,762,684.

BACKGROUND OF THE INVENTION

1. Field of the Invention

The present invention relates to a system for monitoring a remote subject and more particularly to a system for ascertaining an out of boundary condition and transmitting to a central station information pertaining to the condition as well as the location of the subject.

2. Antecedent History

Various monitoring devices for promotion of safety and security of persons and property have been described in U.S. Pat. No. 5,825,283 entitled *System for the Security and Auditing of Persons and Property*, issued to Applicant herein on Oct. 20, 1998 and incorporated herein by reference.

While the previously known monitoring systems were capable of ascertaining the physical location of a subject as well as monitoring the status of vehicular functions and the like, e.g. U.S. Pat. No. 5,450,321, and were further capable of reducing the number of out of boundary condition reports by, for example, providing a time window within which an out of boundary condition may be corrected, as illustrated in U.S. Pat. No. 5,430,432 entitled *Automotive Warning and Recording System*, issued Jul. 4, 1995 to Applicant herein, there was a perceived need to provide a monitoring system capable of both monitoring a physiological parameter condition associated with the subject and thereafter conveying information pertaining to such condition as well as identifying the specific location of the subject for initiating corrective action.

SUMMARY OF THE INVENTION

A processor implemented monitoring system includes a mobile unit comprising a sensor capable of monitoring, on a continuous, predetermined interval or random basis, a physiological parameter of a subject such as heart function, e.g. blood pressure, pulse, blood oxygen level, as well as unique subject identifying physiological parameters such as DNA characteristics obtained from sampling of blood or other fluids such as saliva, perspiration, etc., a retinal scan, a fingerprint scan, voice recognition and the like, coupled with a location ascertaining system, e.g. a GPS system. The mobile unit is coupled via radio, cellular telephone or other wireless or wired communications link with a central station.

The system may be employed to determine, for example, whether an operator of specified equipment is an authorized individual by sampling the identifying physiological parameter and comparing the sampled data with boundary data stored in a processor memory. If an off-limit physiological parameter is detected, e.g. a truck driver has been driving for more than the permitted hours, the monitoring system communicates with the central station to identify the off limit condition and specify the geographic location of the subject for the purpose of summoning help or alerting the proper authorities.

Optionally the physiological parameter boundary data may be stored in a memory at a remote location, e.g. the central station; a central station processor receives the sampling data and determines if an off limit condition exists.

The central station is also capable of signaling the monitoring system processor to implement a corrective action output device such as a vehicle disabling device or, if the monitored parameter is a medical parameter, actuating an implanted pump or transdermal patch for the administration of medication, or other appropriate devices capable of providing assistance in alleviating the emergency physiological condition detected. The processor is also capable for actuating the corrective action output device on its own initiative.

The monitoring system may also be implemented in conjunction with the transport of persons in need of supervision, such as children, handicapped and elderly people on a school bus, ambulette, passenger van, etc.

It should be understood that the terms "student, child and children" as employed hereinafter should be interpreted to encompass elderly, handicapped and any other persons in need of supervision, the terms "school bus" and "vehicle" should be interpreted to include any vehicle or other mode of group transport and the terms "parent and guardian" should be interpreted to include any persons having a supervisory capacity or responsibility for the whereabouts or well being of the child.

The monitoring system may be carried on the bus and ascertains the identity of each child entering the bus for verification of children boarding. The processor then signals the central station when the bus enters the geographic region of a child's bus stop, for example, and the central station thereafter telephones the parent or guardian advising that the child is about to be dropped off. The system also identifies the child when leaving the bus to verify that all children left at their designated stops.

Further implementation, in conjunction with transport of children, is to signal the central station upon each child's entering the bus with the central station telephoning the parent or guardian to confirm that their child is on the bus or the parent accessing such information by telephoning the central station.

From the foregoing compendium, it will be appreciated that it is an aspect of the present invention to provide a monitoring system of the general character described which is not subject to the disadvantages of the antecedent history aforementioned.

It is a feature of the present invention to provide a monitoring system of the general character described which monitors a physiological parameter of a subject, ascertains the location of the subject and transfers information to a central station when the monitored parameter or location are out of predetermined boundary limits.

A consideration of the present invention is to provide a monitoring system of the general character described which monitors a unique identity parameter of a subject and ascertains the location of the subject for verification of the subject's whereabouts.

Another aspect of the present invention is to provide a monitoring system of the general character described which is capable of administering corrective action in the event a monitored parameter is out of its boundary limit.

A further feature of the present invention is to provide a monitoring system of the general character described which is capable of administering medication when a monitored medical status parameter of a subject is out of normal boundary limits.

Another aspect of the present invention to provide a monitoring system of the general character described which monitors a physiological parameter of a subject, ascertains the location of the subject and transfers information to a central station for a determination when the monitored parameter is out of a predetermined boundary limit.

A further consideration of the present invention is to provide a monitoring system of the general character described for auditing school bus occupancy.

Another aspect of the present invention is to provide a monitoring system of the general character described which is capable of communicating with parents or guardians to advise them when a school bus is about to discharge their child at a bus stop.

A still further feature of the present invention is to provide a monitoring system of the general character described which assures that only authorized personnel are operating monitored equipment.

Yet another consideration of the present invention is to provide a monitoring system of the general character described which ascertains the identity of vehicle operators and precludes an operator from operating a vehicle under unsafe conditions, such as exceeding a prescribed number of operating hours without sleep.

Another aspect of the present invention is to provide a monitoring system of the general character described which provides a sense of security and well being to those in need of supervision and to those responsible for the well being of such persons.

Other aspects, features and considerations of the present invention in part will be obvious and in part will be pointed out hereinafter.

With these ends in view, the invention finds embodiment in various combinations of elements, arrangements of parts and series of steps by which the above-mentioned aspects, features and considerations and certain other aspects, features and considerations are attained, or with reference to the accompanying drawings and the scope of which will be more particularly pointed out and indicated in the appended claims.

BRIEF DESCRIPTION OF THE DRAWINGS

In the accompanying drawings in which are shown, some of the various possible exemplary embodiments of the invention.

DESCRIPTION OF THE PREFERRED EMBODIMENTS

Figure 1:
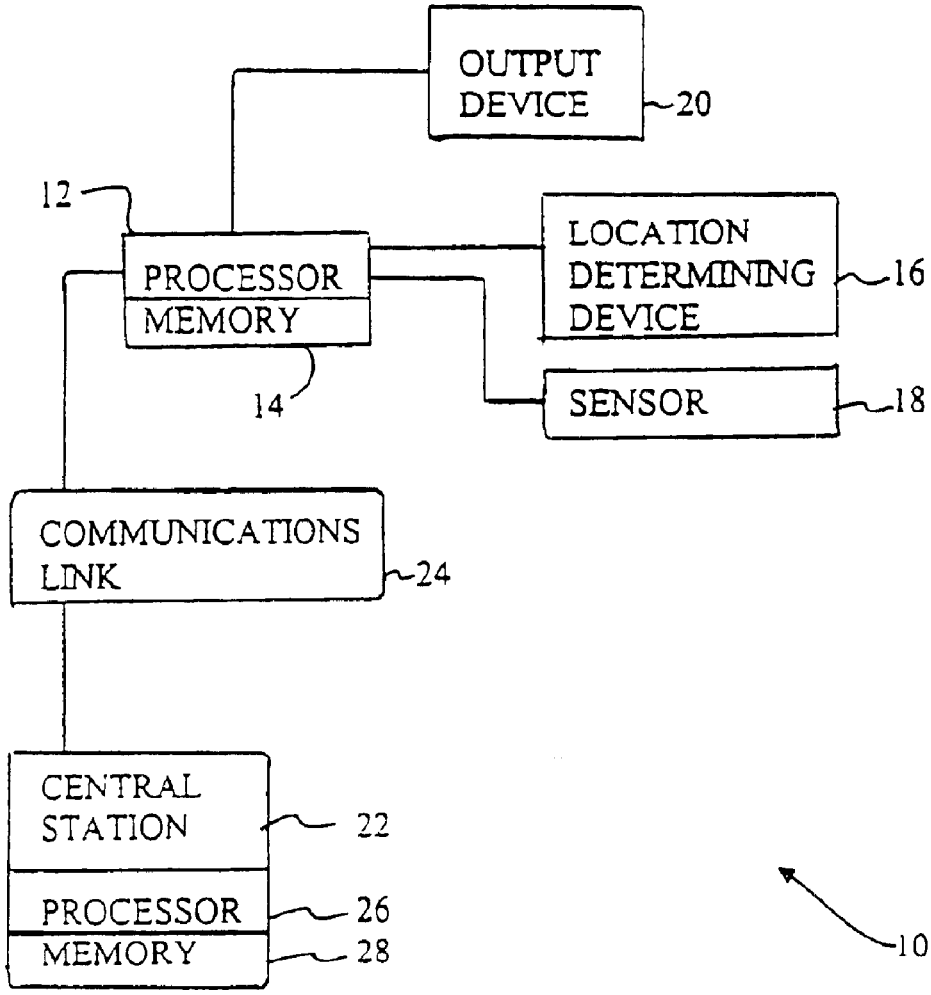
FIG. 1 is a simplified block diagram illustrating a monitoring system constructed in accordance with and embodying the invention and showing a processor interconnected to a central station through a communications link, with processor peripherals including a location determining device and a sensor and with the processor being in communication with an output device for controlling the operation thereof.

Referring now in detail to the drawings, the reference numeral 10 denotes generally a monitoring system constructed in accordance with and embodying the invention. The system 10 includes a processor 12 and an associated memory 14.

Input peripherals such as a location determining device 16, e.g. a GPS based unit, and a sensor 18 are also coupled to the processor 12. A further peripheral such as an output device 20 operates under the control of the processor.

In accordance with the invention, the processor 12 is in communication with a central station 22 through a communications link 24.

Typical components suitable for employment as the processor 12, the memory 14, the location determining device 16, the sensor 18, the output device 20 and the communications link 24 are described in detail in U.S. Pat. No. 5,825,283, which has been incorporated herein by reference.

Pursuant to the invention, the sensor 18 monitors a physiological parameter of a human or animal subject such as blood pressure, pulse, etc. and/or a subject identification physiological parameter such as DNA characteristics obtained from a bodily fluid sample, a retinal scan, a fingerprint scan, voice recognition, visual scan image recognition of facial features, etc.

The sensor 18 and the location determining device 16 input information relating to the monitored parameter and the specific location of the subject respectively to the processor 12. The processor 12 thereafter accesses the memory 14 to ascertain whether or not the monitored physiological parameter data and/or the location data falls within predetermined limits of stored physiological parameter boundary data and stored geographic location boundary data.

In the event either or both types of input data do not fall within the stored boundary limits, the processor 12 generates a signal for initiating corrective action and a signal representative of the specific geographic location of the subject to a central station 22 through the communications link 24.

The processor 12 is capable of initiating corrective action through the output device 20 upon receipt of an appropriate signal from the central station 22 or upon its own initiative. The processor 12 is also programmed to store the monitored data readings in the memory 14 for later review.

The processor 12 can be programmed to constantly or periodically transmit the sensor and location determining device input data directly to the central station 22 through the communications link 24. In such instance, a central station processor 26 accesses a memory 28 in which are stored the physiological parameter boundary data and geographic location boundary data limits.

Figure 2:
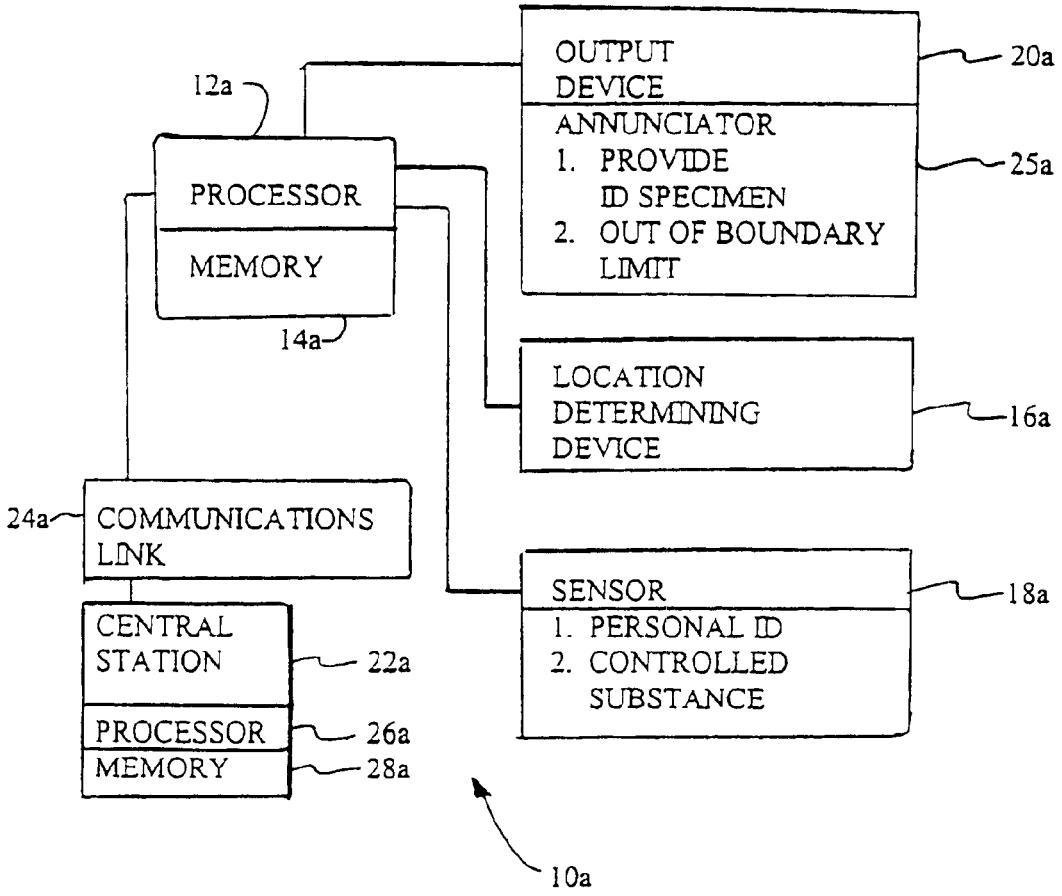
FIG. 2 is a schematized block diagram of a monitoring system constructed in accordance with and embodying the invention configured for monitoring the whereabouts of an individual who is restricted to or proscribed from specified geographic locations.

FIG. 2 illustrates an embodiment of the invention suitable for monitoring an individual who is confined to or restricted from certain geographic areas, such as a person under house arrest, a person subject to a protective order or an individual who is restricted pursuant to a limited release program, on bail or parole. In this embodiment, like numerals have been employed to denote like components as the FIG. 1 embodiment, however, bearing the suffix "a".

In the FIG. 2 embodiment, a monitoring system 10*a* includes a processor 12*a* having an associated memory 14*a*.

Coupled to the processor 12*a* is a location determining device 16*a*, a sensor 18*a* and an output device 20*a*. A central station 22*a* is interconnected to the processor 12*a* through a communications link 24*a*.

The sensor 18*a* is configured to monitor the identity of the subject as by bodily fluid sampling, retinal scan, fingerprint scan and the like. Preferably, such monitoring is conducted on a random basis so that the subject can not anticipate when the next sampling will be required. The output device 20*a* may include an annunciator 25*a* which will advise the subject when to provide a sample for identity verification, however, automatic sampling as by infrared analysis, is also within the preview of the invention. The sensor 18*a* may additionally monitor the subject for verification that the subject is not in violation of any further restrictions, e.g. alcohol consumption, utilizing a controlled substance, failing to take prescribed medication, etc.

Upon the processor 12*a* detecting that the subject is beyond his permitted geographic confines through comparison with location data received from the location determining device 16*a* and the geographic boundaries stored in the memory 14*a*, the processor may implement the annunciator 26*a* to provide an audible or visual warning to the subject simultaneous with or followed by a communication of such out of boundary condition to the central station 22*a*, in the event the subject does not correct the out of boundary condition within a specified time interval.

Upon the processor 12*a* determining that the input data from the sensor pertaining to the identification of the subject and/or other physiological parameters such as, the use of a controlled substance, levels of prescribed medication, is not within the boundaries stored within the memory 14*a*, the processor 12*a* furnishes such information to the central station 22*a*, together with data pertaining to the geographic location of the monitoring system. As with the prior embodiment, the parameter boundary data limits may be stored in a memory 28*a* associated with the central station for access by a central station processor 26*a*.

Figure 3:
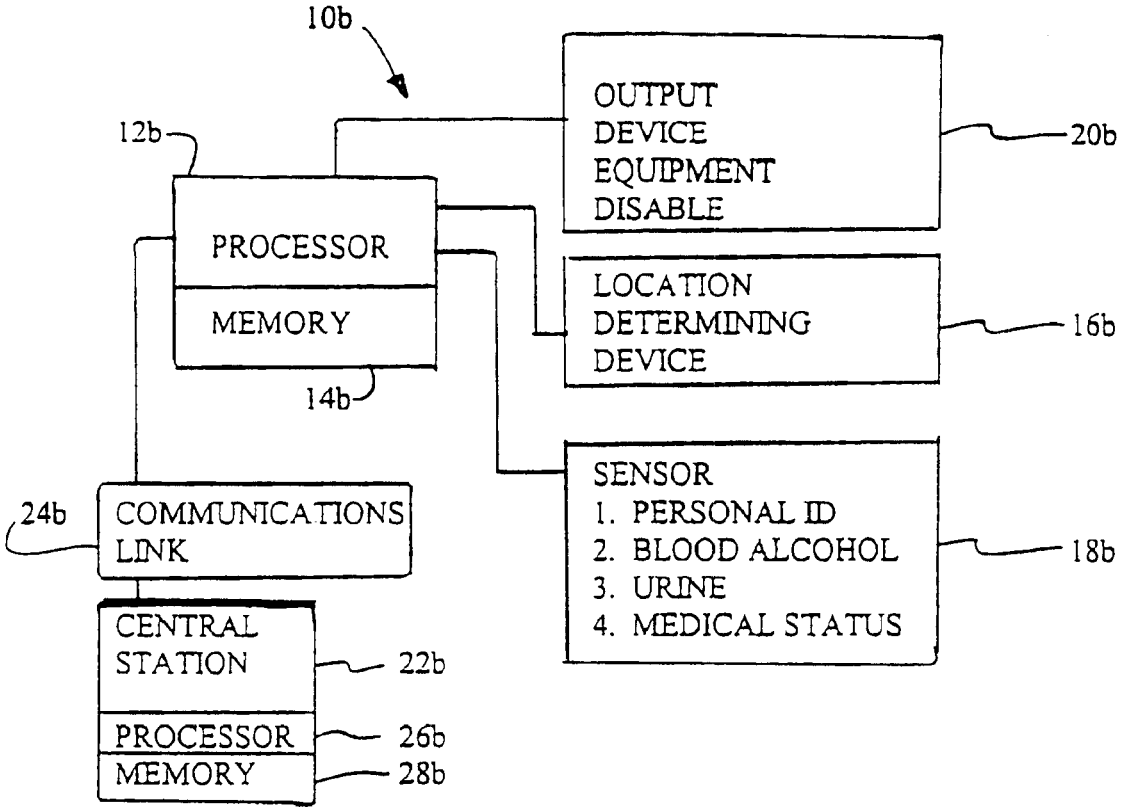
FIG. 3 is a schematized block diagram of a monitoring system constructed in accordance with and embodying the invention in a configuration for monitoring an operator of potentially dangerous or hazardous equipment.

The FIG. 3 embodiment of the monitoring system illustrates a configuration for monitoring the operation of potentially dangerous equipment and assures that it is being operated only by authorized operators who are not subject to impairment.

In this embodiment, a monitoring system 10*b* includes a processor 12*b* coupled through a communications link 24*b* to a memory 14*b*, a location determining device 16*b*, a sensor 18*b*, an output device 20*b* and to a central station 22*b*.

The memory 14*b* carries stored boundary data pertaining to the identification of authorized operators of the equipment as well as each authorized operator's logged hours of operation and data pertaining to time of day restrictions on specified operators, e.g. young or night vision impaired operator's restrictions on time of day hours of operation. Also stored in the memory 14*b* is boundary data pertaining to permitted ranges of physiological parameters representative of unhampered operation of the equipment, such as permitted blood alcohol level, urine analysis levels and other medical status levels.

The processor 12*b* receives operator physiological parameter data from the sensor 18*b* and compares such data with the boundary data stored in the memory to ascertain that the operator of the equipment is authorized, has not exceeded his permitted hours of continuous operation, is otherwise authorized to operate and that the operator's monitored physiological parameters are within limits.

In the event an out of boundary condition is detected, the processor conveys such information to the central station 22*b*, together with the location of the equipment. In this regard, additionally stored in the memory 14*b* are permitted equipment location boundaries as would be employed, for example, if the equipment were a tractor trailer.

The processor 12*b* is capable of controlling an output device 20*b* for implementing corrective action upon its own initiative in the event an out of boundary condition is detected or upon instruction from the central station 22*b*.

Figure 4:
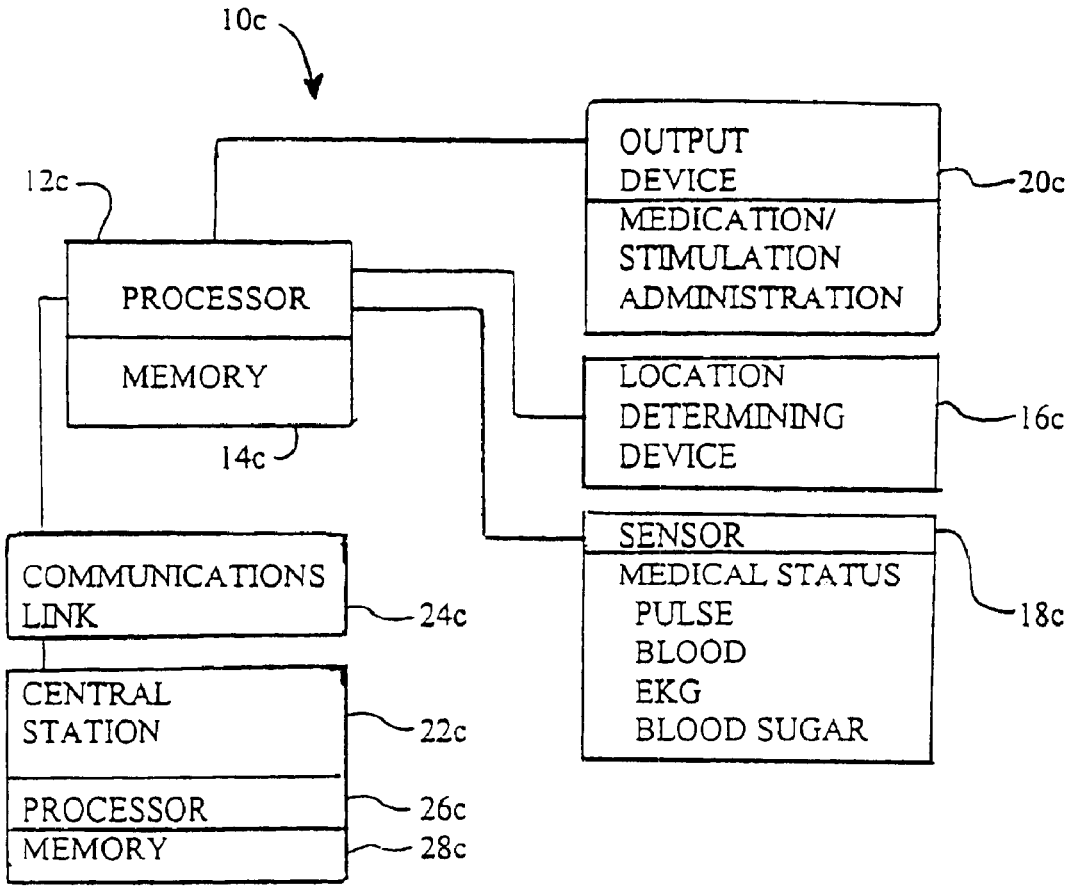
FIG. 4 is a schematized block diagram of a monitoring system constructed in accordance with and embodying the invention configured for monitoring the medical status of a subject and for summoning assistance as well as the administration of corrective aid.

Depicted in FIG. 4 is a further embodiment of the monitoring system configured for implementation in monitoring a subject potentially in need of medical assistance. In this embodiment, like numerals have been employed to denote like components of the prior embodiments, however bearing the suffix "c". A monitoring system 10*c* includes a processor 12*c* interconnected to a memory 14*c*, a location determining device 16*c*, a sensor 18*c* and an output device 20*c*. The processor also communicates with a central station 22*c* through a communications link 24*c*.

The monitoring system 10*c* of this embodiment detects an out of boundary medical parameter condition of a subject, communicates with a central station 22*c* in the event such out of boundary condition is detected and provides for administration of corrective medication and/or stimulation for the purpose of alleviating the condition while help is being summoned.

The sensor 18*c* of this embodiment comprises a medical status sensor for monitoring any one or more of a number of physiological medical parameters such as pulse, blood pressure, EKG, blood sugar, etc. Data signals from the sensor 18*c* are received at the processor 12*c* for comparison with permitted boundary limits of the monitored parameters stored in the memory 14*c*. Upon detection of an out of boundary condition, the processor 12*c* signals the central station 22*c* with identification of the out of boundary condition as well as the location of the subject.

Upon signal from the central station 22*c* or upon its own initiative, the processor 12*c* can actuate a suitable output device 20*c* for the administration of corrective medication or corrective action such as actuation of an implanted left ventricular assist system pump, actuation of a transdermal patch, an implanted insulin or other medication dispensing pump, TENS stimulation, etc.

The output device 20*c* can be actuated while awaiting emergency assistance summoned by the central station 22 and/or continued monitoring of an out of boundary condition to determine whether the corrective action instituted by the output device will suffice to alleviate the condition without the need for outside assistance.

Figure 5:
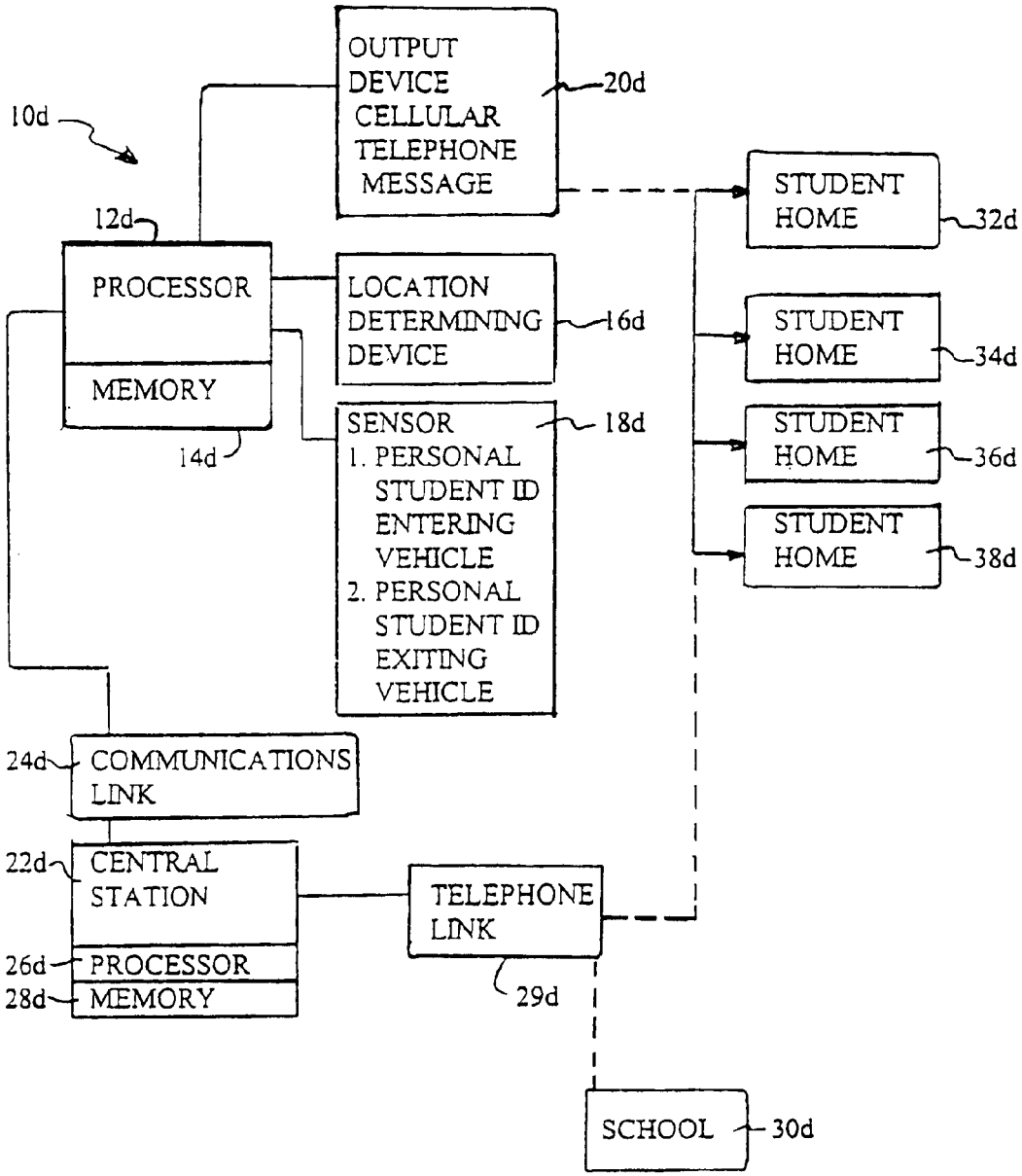
FIG. 5 is a schematized block diagram of a monitoring system constructed in accordance with and embodying the invention configured for monitoring the student occupancy of a school bus and communicating with parents or guardians concerning the whereabouts of their children.

FIG. 5 illustrates a further embodiment of the invention wherein a monitoring system 10*d* is configured to monitor the transportation of children on a school bus. In this embodiment, like numerals have been employed to denote like components of the previous embodiments, however, bearing the suffix "d".

The monitoring system 10*d* includes a processor 12*d* coupled to a memory 14*d*, a location determining device 16*d*, a sensor 18*d* and an output device 20*d*. The processor 12*d* is in communication with a central station 22*d* through a communications link 24*d*.

The monitoring system 10*d* is preferably carried within the transport vehicle, in lieu of being carried on each student.

Pursuant to the invention, the sensor 18*d* accesses personal identification data with respect to each student entering the vehicle and inputs such data to the processor 12*d* for comparison with identification data stored in the memory

14*d* and confirmation of the identity of students who are authorized to board the vehicle.

In the event an unauthorized student attempts to enter the vehicle, the processor 12*d* is programmed to communicate with the central station 22*d* which, in turn, will verify any overriding authorization for the student's presence through a telephone link 29*d* with officials at a school 30*d* and/or telephone communication with the home of the student for parent authorization. Once such authorization is obtained, the central station will communicate with the processor 12*d* to program such student's identity parameters in the memory 14*d* either on a temporary override or permanent basis.

The processor 12*d* also stores in the memory 14*d* an attendance record of all students carried on the vehicle with such information being transmitted to the school 30*d* through the central station 22*d*.

The sensor 18*d* additionally obtains personal identification data of each student exiting the vehicle for comparison with the trip attendance record maintained in the memory 14*d* and verification that no students remain in the vehicle after the morning and afternoon drop off.

Pursuant to the invention, the sensor 18*d* is utilized to obtain the personal identification data of each student entering the vehicle for the return trip home and information received from the location determining device 16*d* is inputted to the processor 12*d* which then compares such information with location parameter data stored in the memory 14*d* pertaining to the designated drop of point, e.g., home or local bus stop, of each student occupant of the vehicle.

Upon the processor detecting that the vehicle is about to enter the student's home area drop off point or local bus stop area, the processor 12*d* communicates to the central station 22*d* or directly communicates via an output device 20*d* such as, a cellular telephone system, to the respective student's homes 32*d*, 34*d*, 36*d* and 38*d* advising the student's parent and/or guardian that their child is about to be dropped off.

It should also be appreciated that the processor 12*d* can be programmed to utilize the output device 20*d* to communicate directly with a student's home upon detecting that an unauthorized student is boarding the vehicle. In such instance, the memory 14*d* would include home identification data pertaining to all students enrolled at the school 30*d* rather than only the students authorized for boarding the particular vehicle.

Additionally, all of the embodiments encompass the monitoring system processor 12, 12*a*, 12*b*, 12*c* and 12*d* transmitting sensor and/or location data to the central station processor 26, 26*a*, 26*b*, 26*c* and 26*d* which accesses parameter limit data stored in its associated memory 28, 28*a*, 28*b*, 28*c* and 28*d* to determine if an out of boundary condition exists.

The central station processor may also access and download further data bases, e.g. state driver license restriction records, for determining boundary limits to be stored in its associated memory.

Thus it will be appreciated that there is provided a monitoring system which achieves the various aspects, features and considerations of the present invention and which is well suited to meet the conditions of practical usage.

Since various possible embodiments might be made of the present invention and since various changes might be made in the exemplary embodiments shown herein without departing from the spirit of the invention, it should be understood that all matter herein described or shown in the accompanying drawings should be interpreted as illustrative and not in a limiting sense.

Having thus described the invention there is claimed as new and desired to be secured by Letters Patent:

1. A system for monitoring the vehicular transport of children or other people in need of supervision, the system comprising a processor, a memory associated with the processor, a sensor carried on a transport vehicle, the sensor monitoring a physiological parameter comprising the identity of each child or other person in need of supervision entering and exiting the transport vehicle, the memory storing identity boundary data of each child or other person in need of supervision entering the vehicle, the processor accessing the memory and determining if there are any children or other people in need of supervision remaining on the transport vehicle after a last scheduled drop off.

2. A system for monitoring the vehicular transport of children or other people in need of supervision as constructed in accordance with claim 1 further including a location determining device carried on the transport vehicle, the location determining device generating vehicle location data, the memory storing boundary data relating to the geographic location of a designated drop off point for each child or other person in need of supervision present on the vehicle, the processor receiving the vehicle location data and accessing the memory to determine when each child or other person in need of supervision is approaching their designated drop off point, the processor initiating an advisory communication to the parent or person responsible for the well being of each child or other person in need of supervision before the vehicle reaches each child's designated drop off point.

3. A system for monitoring the vehicular transport of children or other people in need of supervision as constructed in accordance with claim 1, the processor initiating a communication when a child or other person in need of supervision whose physiological parameter data does not lie within the identity boundary data enters the vehicle.

4. A system for monitoring the vehicular transport of children or other people in need of supervision as constructed in accordance with claim 1 wherein the processor and the memory are carried on the vehicle.

5. A system for monitoring the vehicular transport of children or other people in need of supervision on a vehicle, the system comprising a processor, a memory associated with the processor, a location determining device carried on the vehicle, the location determining device generating vehicle location data, a sensor carried on the vehicle, the sensor monitoring a physiological parameter comprising the identity of each child or other person in need of supervision on the vehicle, the memory storing geographic location boundary data pertaining to each child or other person in need of supervision on the vehicle, the processor receiving the vehicle location data and comparing the vehicle location data with the stored location boundary data pertaining to each child or other person in need of supervision, the processor determining when the vehicle is about to enter a designated drop off point for each child or other person in need of supervision, the processor initiating a communication before the vehicle reaches each designated drop off point.

* * * * *